US007448558B2

(12) United States Patent
Wang

(10) Patent No.: US 7,448,558 B2
(45) Date of Patent: Nov. 11, 2008

(54) WATER SPRINKLING ASSEMBLY

(76) Inventor: Tzu-Meng Wang, No. 91, Kwo-Tai Rd., Chu-Nan Chen, Miao-Li Hsien (TW)

( * ) Notice: Subject to any disclaimer, the term of this patent is extended or adjusted under 35 U.S.C. 154(b) by 168 days.

(21) Appl. No.: 11/602,216

(22) Filed: Nov. 21, 2006

(65) Prior Publication Data

US 2008/0116297 A1 May 22, 2008

(51) Int. Cl.
*A62C 31/02* (2006.01)

(52) U.S. Cl. ..... 239/394; 239/242; 239/273; 239/275; 239/289; 239/444; 239/447; 239/548; 239/DIG. 1

(58) Field of Classification Search ..... 239/242, 239/273, 275, 276, 279, 289, 390, 394, 444, 239/446, 447, 548, DIG. 1
See application file for complete search history.

(56) References Cited

U.S. PATENT DOCUMENTS 2,566,781 A * 9/1951 Tetzlaff et al. ..... 239/273
4,347,981 A 9/1982 Hayes
4,784,327 A * 11/1988 Lund ..... 239/276
5,350,115 A * 9/1994 Burnworth et al. ..... 239/242
5,511,727 A * 4/1996 Heren et al. ..... 239/242
5,566,886 A 10/1996 Wang
5,598,978 A 2/1997 Wang
5,683,035 A * 11/1997 Wang ..... 239/394
5,746,375 A * 5/1998 Guo ..... 239/276
6,196,476 B1 3/2001 Wang
6,808,129 B1 * 10/2004 Wang ..... 239/DIG. 1

* cited by examiner

*Primary Examiner*—Steven J Ganey
(74) *Attorney, Agent, or Firm*—Posz Law Group, PLC

(57) ABSTRACT

A water sprinkling assembly includes a base having a first L shaped tube and a second L shaped tube respectively and oppositely provided on an inner side face of a recessed area in the base, and a sprinkling disk rotatably connected to the base and having multiple sprinkling holes and two opposed blind holes with a water guiding track formed on a bottom face of the sprinkling disk to connect the two blind holes together such that when the two blind holes are aligned with the first outlet and the second inlet of the base respectively, the water will be guided directly from the first outlet to the second inlet and eventually flows out of the base via the second outlet of the base for a different application.

6 Claims, 6 Drawing Sheets

WATER SPRINKLING ASSEMBLY

BACKGROUND OF THE INVENTION

1. Field of the Invention

The present invention relates to a water sprinkling assembly, and more particularly to a water sprinkling assembly capable of providing water to an additional water dispensing structure which is adapted to connected to the water sprinkling assembly.

2. Description of the Prior Art

One of the current available water dispensing assemblies is normally composed of a base, a dispensing disk and a sprinkling disk which is rotatable relative to the base. Each of the dispensing disk and he sprinkling disk is provided with multiple through holes selectively communicating with an inlet in the base such that water flowing to the inlet of the base is able to selectively flow out of the water dispensing assembly via he through holes and dispensed in various patterns according to the shape of the through holes chosen.

Another water dispensing assembly is composed of a base and a tube pivotally received in the base and having multiple holes defined through a side face of the tube such that after the base is connected to a water source, water from the water source is able to flow to the tube and dispensed out of the tube from the holes.

No matter what type of the water dispensing assembly the user chooses to use, the user is limited to one certain types of water dispensing patterns. That is, either the user chooses the sprinkling pattern or the pivotally sprinkling pattern, or the user has to purchase an additional tube for a second water dispensing assembly. There is no provision of a single mechanism for the user to combine the water dispensing features of the two different water dispensing assemblies.

To overcome the shortcomings, the present invention tends to provide an improved water sprinkling assembly to mitigate the aforementioned problems.

SUMMARY OF THE INVENTION

The primary objective of the present invention is to provide an improved water sprinkling assembly having a sprinkling disk having two blind holes and a water guiding track formed on a bottom face of the sprinkling disk such that water coming from a water source is guided from one blind hole to the other blind hole via the water guiding track for application. Thereafter, the user is able to directly connect the water sprinkling assembly to a secondary water dispensing assembly and still water can be provided to the secondary water dispensing assembly.

In order to accomplish the aforementioned objective, the water sprinkling assembly of the present invention is composed of a base, a dispensing disk and a sprinkling disk. The base has a first L shaped tube and a second L shaped tube separated from the first L shaped tube. The dispensing disk has multiple dispensing holes defined through the dispensing disk and the sprinkling disk has multiple sprinkling holes, two oppositely defined blind holes and a water guiding track formed on a bottom face of the sprinkling disk to communicate with the two blind holes. Therefore, the water is able to flow out of the sprinkling holes when the blind holes are not aligned with either one of the first L shaped tube and the second L shaped tube. Also, the water is able to flow out of the water sprinkling assembly for a different application when the two blind holes are respectively aligned with the first L shaped tube and the second L shaped tube.

Other objects, advantages and novel features of the invention will become more apparent from the following detailed description when taken in conjunction with the accompanying drawings.

DETAILED DESCRIPTION OF THE PREFERRED EMBODIMENT

Figure 1:
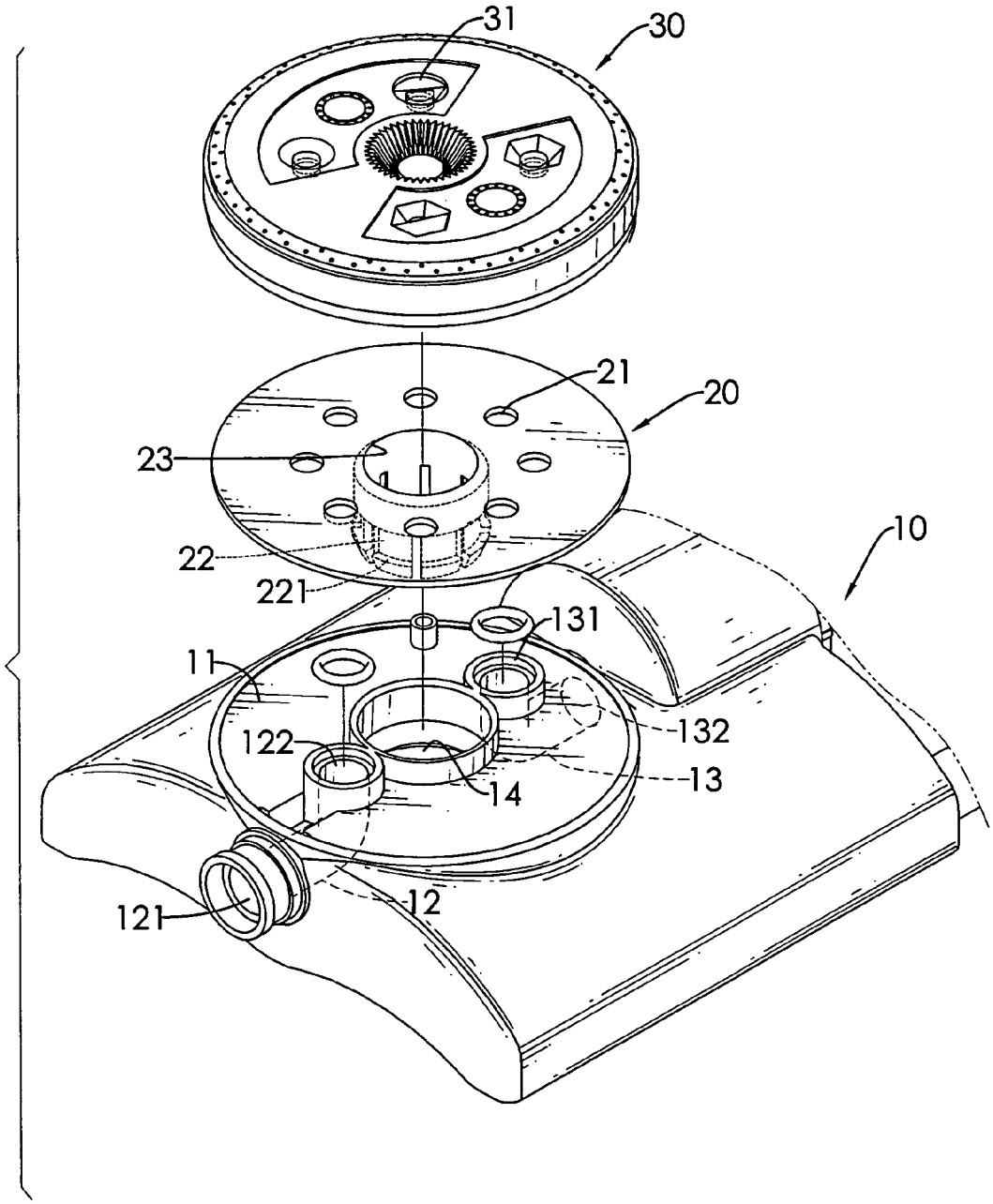
FIG. 1 is an exploded perspective view of the water sprinkling assembly of the present invention.
Figure 2:
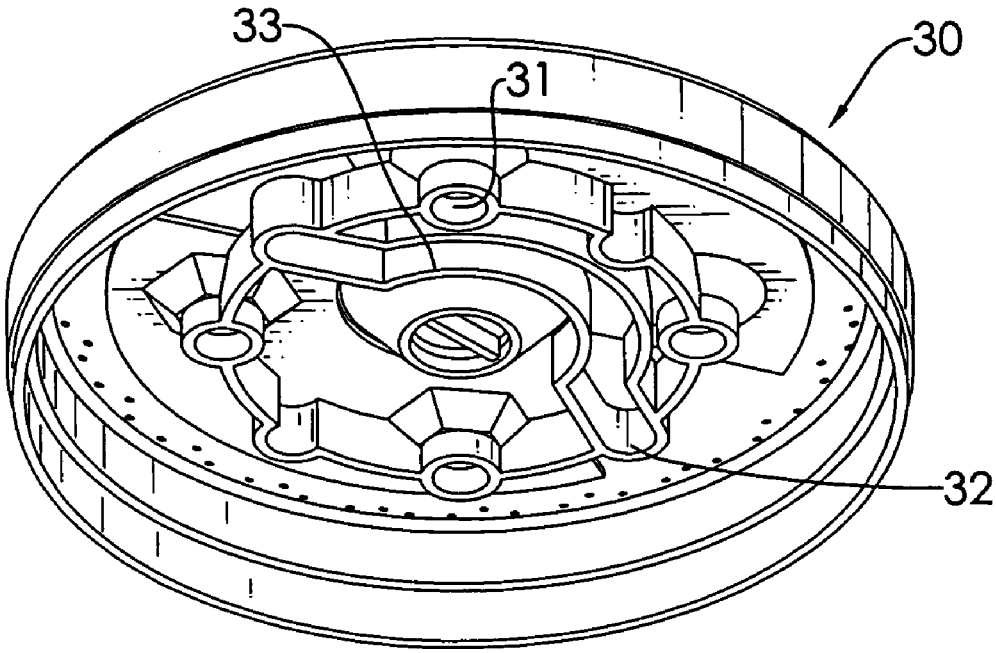
FIG. 2 is a perspective view of the sprinkling disk of the present invention.

With reference to FIGS. 1 and 2, it is noted that the water sprinkling assembly in accordance with the present invention includes a base (10), a dispensing disk (20) and a sprinkling disk (30).

The base (10) includes a recessed area (11), a first L shaped tube (12) formed on a side face defining the recessed area (11) and a second L shaped tube (13) formed on the side face defining the recessed area (11) and opposed to that of the first L shaped tube (12). The first L shaped tube (12) has a first inlet (121) extending out of the base (10) and a first outlet (122) extending upward inside the recessed area (11). The second L shaped tube (13) has a second inlet (131) extending upward inside the recessed area (11) and a second outlet (132) extending out of the base (10). An assembly hole (14) is defined in a bottom face defining the recessed area (11) to separate the first outlet (122) from the second inlet (131).

The dispensing disk (20) has multiple dispensing holes (21) defined through a side face of the dispensing disk (20) and an extension (22) extending downward from a central portion of the dispensing disk (20) and provided with barbs (221) formed on an outer side face of the extension (22). The extension (22) corresponds to and is able to extend into the assembly hole (14) of the base (10) to allow the barbs (221) to engage with a peripheral edge of the assembly hole (14) to secure engagement between the base (10) and the dispensing disk (20). A connection hole (23) is centrally in the dispensing disk (20).

The sprinkling disk (30) is securely connected to the dispensing disk (20) and has multiple sprinkling holes (31) defined through a side face of the sprinkling disk (30) each communicating with a corresponding one of the dispensing holes (21) of the dispensing disk (20) and two blind holes (32) with a water guiding track (33) formed on a bottom face of the sprinkling disk (30) connecting the two blind holes (32) together. From the provision of the connection hole (23), it is noted that the sprinkling disk (30) is provided with a connection portion extending downward from a bottom face of the sprinkling disk (30). Extension of the connection portion of the sprinkling disk (30) into the connection hole (23) of the dispensing disk (20) secures the engagement between the dispensing disk (20) and the sprinkling disk (30). Because the engagement between the sprinkling disk (30) and the base (10) and the connection between the dispensing disk (20) and the sprinkling disk (30) are conventional in the art, detailed description thereof is omitted for brevity and lengthy description of unrelated structural relationship is avoided.

After the water sprinkling assembly of the present invention is assembled, it is noted that each one of the sprinkling holes (31) is able to correspond to and aligned with the first outlet (122) or the second inlet (131) via the dispensing holes (21). Also, the two blind holes (32) are able to respectively correspond to and aligned with the first outlet (122) and the second inlet (131) as the sprinkling disk (30) rotates relative to the base (10).

Figure 3:
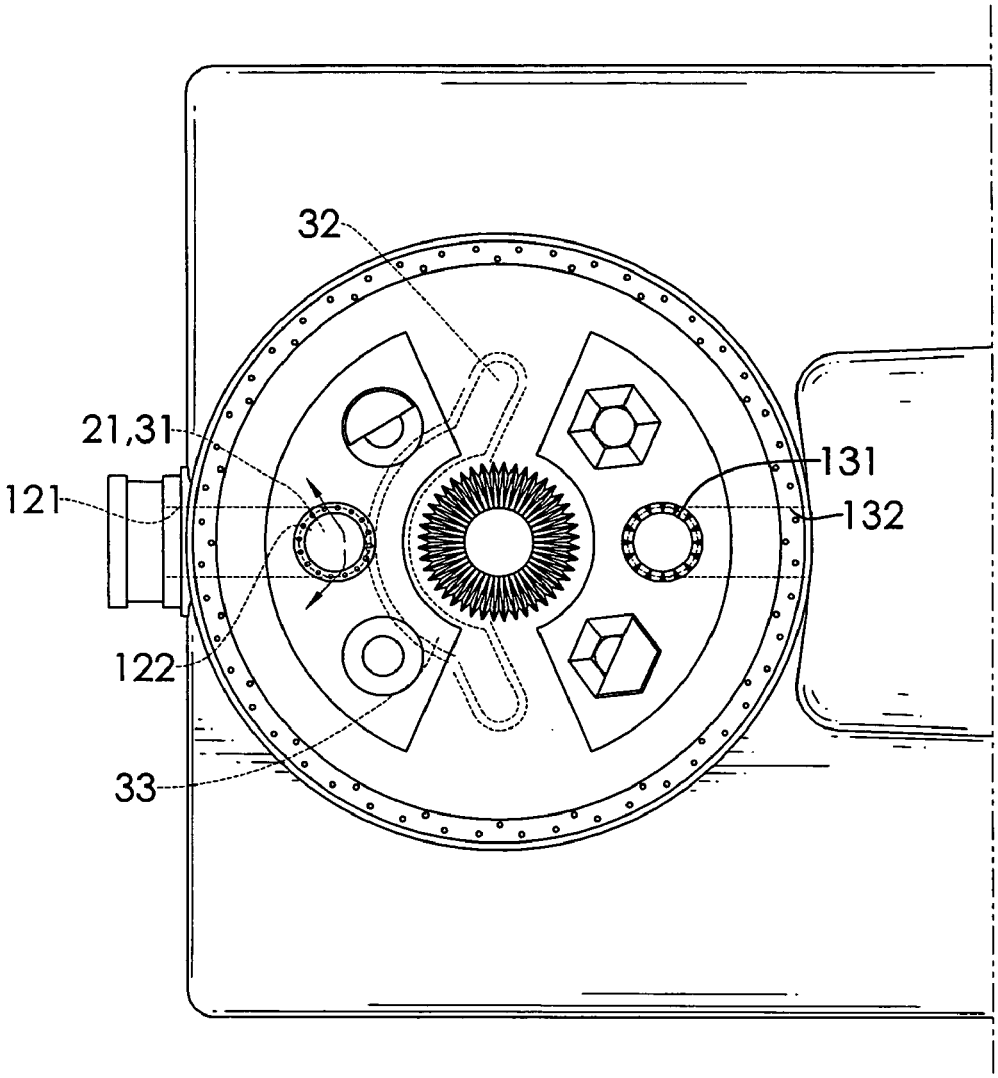
FIG. 3 is a schematic top plan view showing that water is flowing out of the sprinkling holes of the sprinkling disk.
Figure 4:
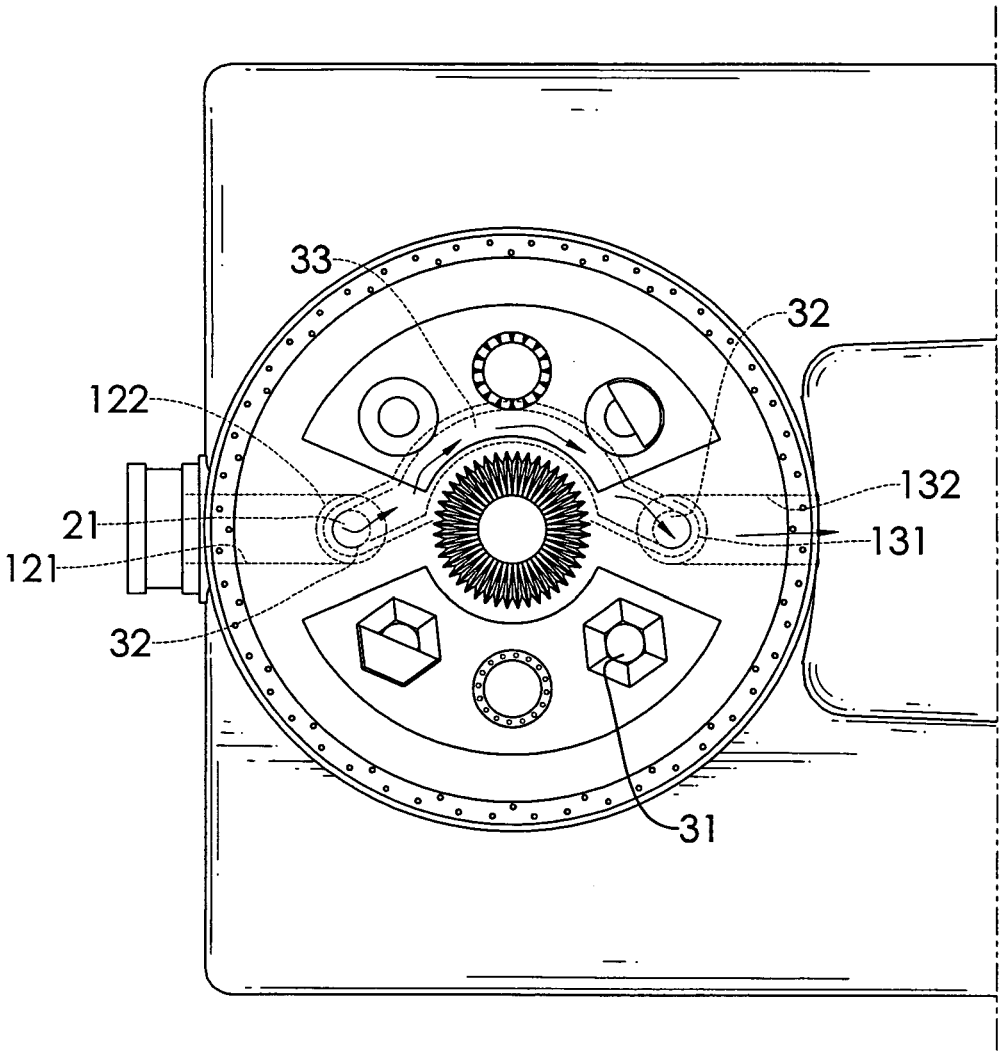
FIG. 4 is a schematic top plan view showing that water is flowing out of the water sprinkling assembly via the water guiding track for a different application.

With reference to FIGS. 3 and 4, it is noted that when the first outlet (122) is aligned with one of the dispensing holes (21) of the dispensing disk (20) and one of the sprinkling holes (31) of the sprinkling disk (30), water from a water source which is connected to and communicates with the first inlet (121) of the base (10) is able to flow out of the sprinkling disk (30) via the corresponding sprinkling hole (31). However, when both blind holes (32) are respectively aligned with two corresponding dispensing holes (21), the first outlet (122) and the second inlet (131) of the base (10), the water from the water source is guided by the water guiding track (33) from one blind hole (32) to the other blind hole (32), which guides the water from the first outlet (122) to the second inlet (131). As a result, the water flows out of the water sprinkling assembly via the second outlet (132) of the present invention without passing through the sprinkling holes (31) of the sprinkling disk (30).

Figure 5:
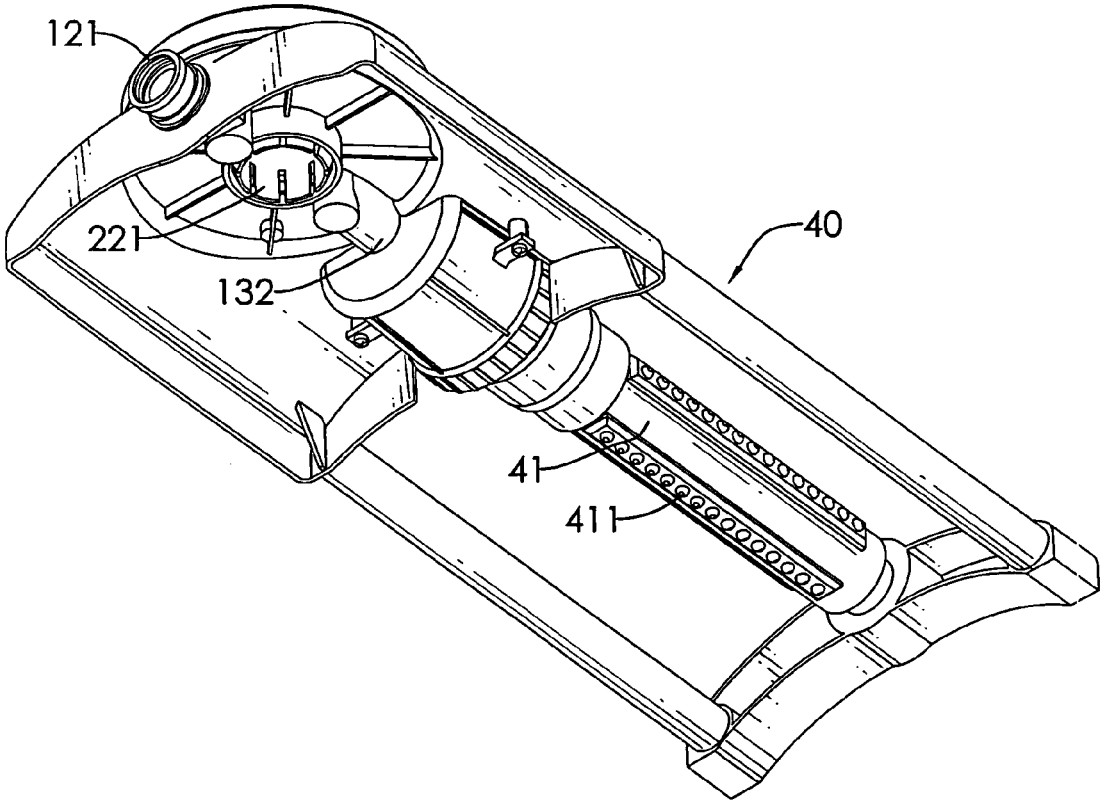
FIG. 5 is a perspective view showing that the water sprinkling assembly of the present invention with a second water dispensing assembly.
Figure 6:
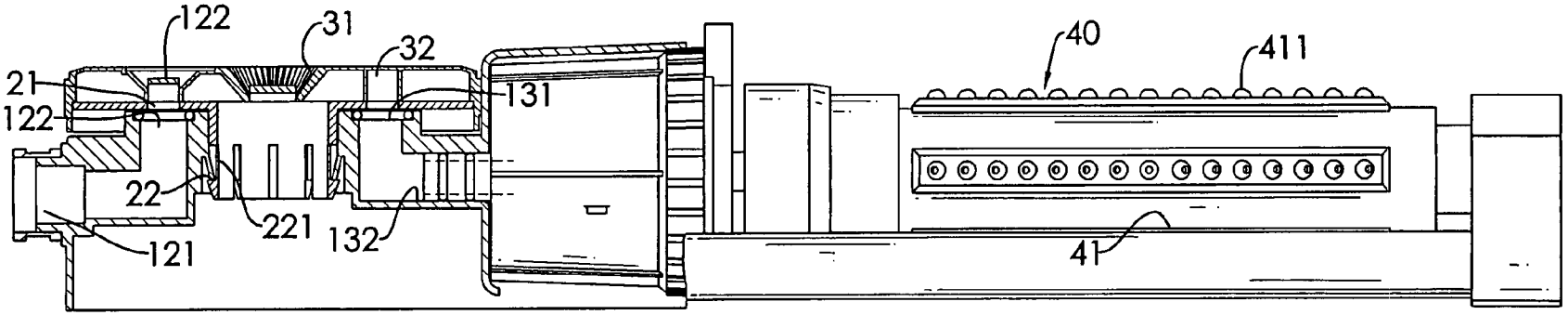
FIG. 6 is a schematically cross sectional view showing the water flow to the second water dispensing assembly.

With reference to FIGS. 5 and 6, it is noted that a second water dispensing assembly (40) is provided to the water sprinkling assembly of the present invention, wherein the second water dispensing assembly (40) is connected to and communicates with the second outlet (132) of the water sprinkling assembly.

The second water dispensing assembly (40) has a tube (41) with one open end and a closed end. The open end of the tube (41) is connected to and communicates with the second outlet (132). The tube (40) further has multiple holes (411) defined through a side face of the tube (40). Therefore, when water is flowing from the first inlet (121) to the second outlet (132) via the first outlet (122), one of the dispensing holes (21), one of the blind holes (32), the water guiding track (33), the other blind hole (32), a different dispensing hole (21) and the first inlet (131), the user is able to choose either the water sprinkling assembly of the present invention or the second water dispensing assembly depending one what goal is to be accomplished.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A water sprinkling assembly comprising:

a base having a first L shaped tube and a second L shaped tube respectively and oppositely provided on an inner side face of a recessed area defined in the base, wherein the first L shaped tube has a first inlet extending out of the base for connection to a water source and a first outlet communicating with the first inlet and extending upward inside the recessed area, the second L shaped tube has a second inlet extending upward inside the recessed area and a second outlet extending out of the base and communicating with the second inlet;

a dispensing disk securely mounted on top of the base and having multiple dispensing holes defined through a side face of the dispensing disk; and a sprinkling disk rotatably connected to the base and securely engaged with the dispensing disk, the sprinkling disk having multiple sprinkling holes each communicating with a corresponding one of the dispensing holes of the dispensing disk and two opposed blind holes with a water guiding track formed on a bottom face of the sprinkling disk to connect the two blind holes together such that when two of the sprinkling holes are aligned with the first outlet and the second inlet of the base respectively, water from a water source is able to be sprinkled out of the sprinkling holes and when the two blind holes are aligned with the first outlet and the second inlet of the base respectively, the water will be guided directly from the first outlet to the second inlet and eventually flows out of the base via the second outlet of the base for a different application.

2. The sprinkling assembly as claimed in claim 1, wherein the first L shaped tube and the second L shaped tube are separated from each other via an assembly hole which is defined in a bottom face defining the recessed area.

3. The sprinkling assembly as claimed in claim 2, wherein the dispensing disk has an extension extending downward from a central portion of the dispensing disk to be securely received inside the assembly hole of the base to secure engagement between the dispensing disk and the base.

4. A water sprinkling assembly comprising:

a base having a first L shaped tube and a second L shaped tube respectively and oppositely provided on an inner side face of a recessed area defined in the base, wherein the first L shaped tube has a first inlet extending out of the base for connection to a water source and a first outlet communicating with the first inlet and extending upward inside the recessed area, the second L shaped tube has a second inlet extending upward inside the recessed area and a second outlet extending out of the base and communicating with the second inlet, an assembly hole is defined in a bottom face defining the recessed area to separate the first L shaped tube from the second L shaped tube;

a dispensing disk securely mounted on top of the base and having multiple dispensing holes defined through a side face of the dispensing disk; and a sprinkling disk rotatably connected to the base and securely engaged with the dispensing disk, the sprinkling disk having multiple sprinkling holes each communicating with a corresponding one of the dispensing holes of the dispensing disk and two opposed blind holes with a water guiding track formed on a bottom face of the sprinkling disk to connect the two blind holes together such that when two of the sprinkling holes are aligned with the first outlet and the second inlet of the base respectively, water from a water source is able to be sprinkled out of the sprinkling holes and when the two blind holes are aligned with the first outlet and the second inlet of the base respectively, the water will be guided directly from the first outlet to the second inlet and eventually flows out of the base via the second outlet of the base for a different application.

5. The sprinkling assembly as claimed in claim 4, wherein the dispensing disk has an extension extending downward from a central portion of the dispensing disk to be securely received inside the assembly hole of the base to secure engagement between the dispensing disk and the base.

6. A water sprinkling assembly comprising:

a base having a first L shaped tube and a second L shaped tube respectively and oppositely provided on an inner side face of a recessed area defined in the base, wherein the first L shaped tube has a first inlet extending out of the base for connection to a water source and a first outlet communicating with the first inlet and extending upward inside the recessed area, the second L shaped tube has a second inlet extending upward inside the recessed area and a second outlet extending out of the base and communicating with the second inlet, an assembly hole is defined in a bottom face defining the recessed area to separate the first L shaped tube from the second L shaped tube;

a dispensing disk securely mounted on top of the base and having multiple dispensing holes defined through a side face of the dispensing disk and an extension extending downward from a central portion of the dispensing disk to be securely received inside the assembly hole of the base to secure engagement between the dispensing disk and the base; and a sprinkling disk rotatably connected to the base and securely engaged with the dispensing disk, the sprinkling disk having multiple sprinkling holes each communicating with a corresponding one of the dispensing holes of the dispensing disk and two opposed blind holes with a water guiding track formed on a bottom face of the sprinkling disk to connect the two blind holes together such that when two of the sprinkling holes are aligned with the first outlet and the second inlet of the base respectively, water from a water source is able to be sprinkled out of the sprinkling holes and when the two blind holes are aligned with the first outlet and the second inlet of the base respectively, the water will be guided directly from the first outlet to the second inlet and eventually flows out of the base via the second outlet of the base for a different application.

* * * * *